US006715384B1

(12) United States Patent
Kozak

(10) Patent No.: US 6,715,384 B1
(45) Date of Patent: Apr. 6, 2004

(54) MULTI-FUNCTIONAL FASTENER DRIVER DEVICE

(76) Inventor: Burton Kozak, 1300 N. Lake Shore Dr., #28C, Chicago, IL (US) 60610

( * ) Notice: Subject to any disclaimer, the term of this patent is extended or adjusted under 35 U.S.C. 154(b) by 0 days.

(21) Appl. No.: 09/568,299

(22) Filed: May 9, 2000

(51) Int. Cl.[7] ..... B25B 13/00
(52) U.S. Cl. ..... 81/124.2; 81/176.5
(58) Field of Search ..... 81/124.2, 176.15, 81/176.2, 121.1

(56) References Cited

U.S. PATENT DOCUMENTS

| | | | | | |
|---|---|---|---|---|---|
| 445,451 | A | * | 1/1891 | Miller | 81/124.2 |
| 4,724,731 | A | * | 2/1988 | Onofrio | 81/124.2 |
| 4,823,650 | A | * | 4/1989 | Tuttle | 81/121.1 |
| 5,048,378 | A | * | 9/1991 | Nikolas | 81/124.2 |
| 5,361,657 | A | * | 11/1994 | Terry | 81/124.6 |
| 5,697,268 | A | * | 12/1997 | Makovsky et al. | 81/121.1 |
| 6,198,049 | B1 | * | 3/2001 | Korinek | 81/121.1 |
| 6,294,719 | B1 | * | 9/2001 | Palecki et al. | 81/124.4 |

* cited by examiner

*Primary Examiner*—Lee D. Wilson
(74) *Attorney, Agent, or Firm*—Cherskov & Flaynik

(57) ABSTRACT

A multi-functional fastener driver device 10 that is capable of providing rotational force to fasteners having different configurations (hexagonal, flathead, wingnut or hook screw, for example) to urge a preselected fastener into a workpiece. The device 10 includes a first portion 12 that is secured, via a shank portion 16, to a tool providing rotary force, and a second portion 14 that transfers the rotary force to a preselected fastener via a plurality of arm members 30. The arm members 30 are configured from multiple apertures 24 and 38, and slots 32 and 34. The arm members 30 engage the fastener and force the fastener to rotate thereby "screwing" the fastener into the workpiece. When fasteners are to large to rotate without deforming the arm members 30, a sleeve 42 is utilized to snugly receive the device 10 therein to maintain the arm members 30 configuration while rotating the fastener. Further, the sleeve 42 includes opposing recesses 52 in an end wall 50. The recesses 52 are adapted to align with a slot 32 or 34 in a fastener receiving end 25 of the device 10 to allow the drive ends of large fasteners to be engaged by both the device 10 and the sleeve 42.

35 Claims, 18 Drawing Sheets

MULTI-FUNCTIONAL FASTENER DRIVER DEVICE

BACKGROUND OF THE INVENTION

1. Field of the Invention

The present invention relates generally to fastener drivers and, more particularly, to fastener drivers that are capable of providing rotational force to fasteners having different sizes and configurations.

2. Background of the Prior Art

Fastener drivers that provide rotational motion to urge fasteners into a workpiece, come in a variety of sizes and configurations. These drivers are designed to cooperate with the size and configuration of a preselected fastener. Some fastener configurations are non-symmetrical or "odd" shaped and present problems in providing a driver that is capable of receiving and rotating the fastener. Examples of these odd shaped fasteners include flathead, wingnut and hook screw.

Prior art drivers that are capable of rotating these odd shaped fasteners, are relegated to engaging only one shape of fastener. Further, prior art drivers have only limited tolerance for fastener dimensional variations corresponding to the preselected shape. Examples of prior art fastener drivers are disclosed in U.S. Pat. Nos. 5,697,268; 4,724,731; 4,706,380; 3,812,894; 3,742,533; and Des. 379,420. None of these prior art devices provide a tool that will deliver rotary motion to two or more odd shaped fasteners including but not limited to flathead, wingnut or hook screw. When confronted with two or more different fasteners, two or more different fastener drivers are required. A need exists for a multi-functional fastener driver device that will deliver rotational force to a variety of fastener configurations within predetermined dimensional ranges for the respective fastener.

SUMMARY OF THE INVENTION

It is an object of the present invention to provide a multi-functional fastener driver device that overcomes many of the disadvantages of the prior art.

A principle object of the present invention is to provide a device that allows an individual to use one tool to drive one of several types and sizes of fastener into a workpiece. A feature of the device is that it has multiple slots and apertures to receive a preselected fastener. An advantage of the device is that it replaces several drive tools with one when driving different sized or configured fasteners.

Another object of the present invention is to provide multiple hexagonally configured apertures. A feature of the device is "nested" hexagonal apertures. An advantage of the device is that it allows several sizes of hex head fasteners to be driven into a workpiece with only one fastener driver.

Still another object of the present invention is to provide a method of preventing deformation of the device when driving large fasteners. A feature of the device is a cylindrical configuration that allows the device to be forcibly inserted into a sleeve. An advantage of the device is that it is capable of driving large fasteners without damage to arm members that engage and rotate the head of the fastener.

Yet another object of the present invention is to provide a method of rotating large hook screw or flathead fasteners. A feature of the device is a preselected slot in a fastener receiving end of the device that aligns with a pair of opposing recesses in an end wall of the sleeve. An advantage of the device is that it is capable of driving the large fasteners without damage to the arm members or the fastener.

A further object of the invention is to provide a device that transfers rotary motion to a wingnut fastener. A feature of the device is a substantially "V" configured outer recess having converging side walls and a base wall. An advantage of the device is that it guides the "wings" of the wingnut into snug engagement with cooperating portions of the base and side walls for efficient transfer of rotary motion to the wingnut.

Another object of the invention is to provide a device that transfers rotary motion to a variety of fastener configurations including wingnut, hook screw or flathead. A feature of the device is an inner rectangular configured recess radially displaced from the outer substantially "V" configured recess. An advantage of the device is that it is capable of providing rotary motion to a variety of fastener configurations having a relatively wide range of dimensions.

Another object of the invention is to increase the area of engagement between the fastener and the device. A feature of the device is a plurality of hub engagement sectors having concave surfaces corresponding to a convex surface of a hub portion of the wingnut. An advantage of the device is that it stabilizes the wingnut as the wingnut is forcibly rotated by the device.

Still another object of the invention is to provide a device that is capable of forcibly driving a stud bolt, which removably receives a wingnut, into a workpiece. A feature of the device is a straight threaded second orifice "nested" in a first orifice. An advantage of the device is that one tool anchors the stud bolt and forcibly tightening the wingnut upon the stud bolt.

Yet another object of the invention is to increases the area of engagement between the "wings" of the wingnut and the device. A feature of the device is a sectioned base wall in the outer recess of the device. An inner planar section of the base wall engages a planar portion of the wings of the wingnut. A planar angled or alternatively arcuate outer section of the base wall engages an arcuate portion of the wings of the wingnut. An advantage of the device is that it will not deform the wings of wingnut when forcibly rotating the wingnut into a "tightened" or "loosened" position.

Yet another object of the present invention is to increase the "gripping" capability of the outer recess when rotationally engaging the wings of the wingnut. A feature of the device is knurled surfaces on side and base walls of the outer recess. An advantage of the device is that it increases the rotational force received by the wingnut from the device.

Another object of the present invention is to provide a relatively large stud bolt receiving first orifice in the device. A feature of the device is a relatively lengthly longitudinal dimension for the first orifice. An advantage of the device is that it internally receives a stud bolt having a relatively long portion extending through and beyond a wingnut tightened upon the stud bolt. Internally receiving the stud bolt, allows the device to snugly engage the wingnut to forcibly rotate the wingnut in a "tightening" or "loosening" direction.

Briefly, the invention provides a multi-functional fastener comprising a first portion having means for receiving rotary motion; a second portion integrally joined to said first portion, said second portion having means for transferring rotary motion to a fastener; said rotary motion receiving means including a shank having a hexagonal configuration, said rotary motion transferring means further comprising a hexagonal configured aperture extending longitudinally from a fastener receiving end of said second portion; a first slot for receiving a flathead fastener having a first dimensions, said first slot extending longitudinally from said fastener receiving end of said second portion; and a second slot for receiving a flathead fastener having second dimensions, said second slot extending longitudinally from said fastener receiving end of said second portion.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
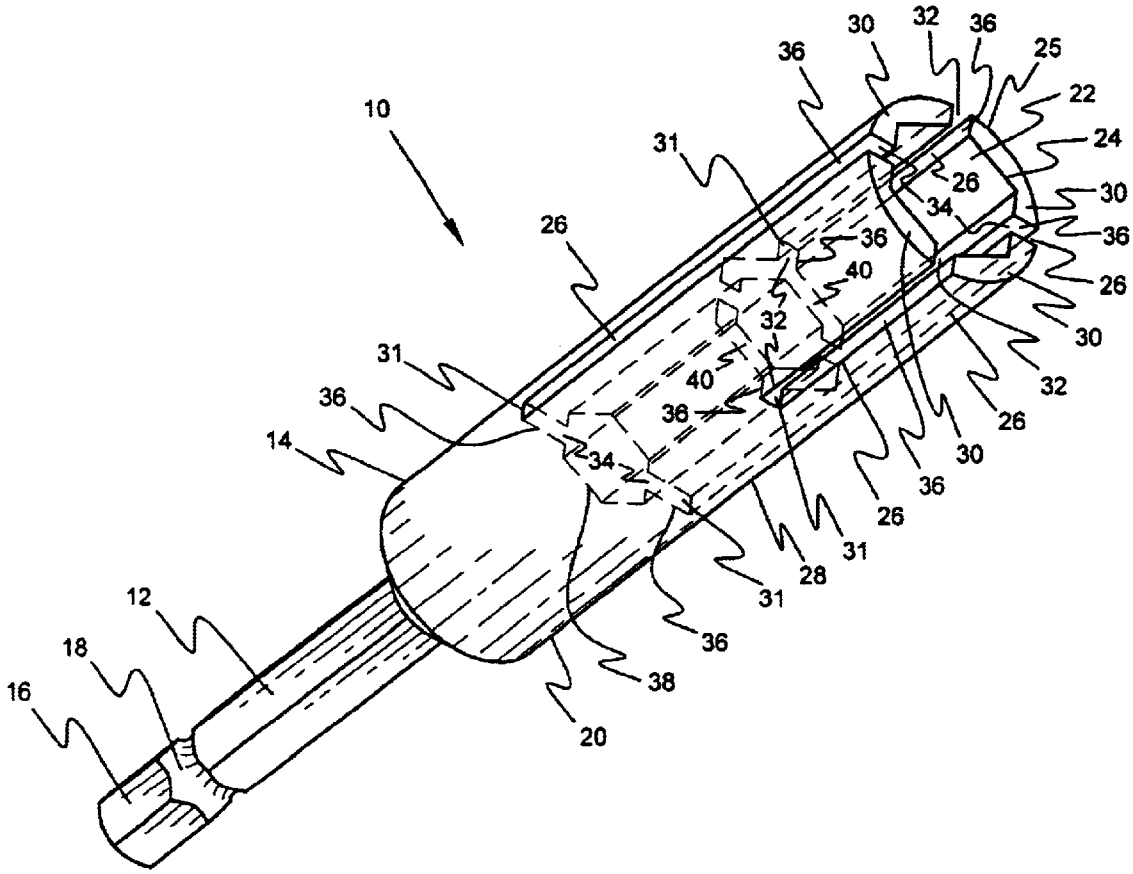
FIG. 1 is a phantom, front perspective view of a multi-functional fastener driver device in accordance with the present invention.
Figure 2:
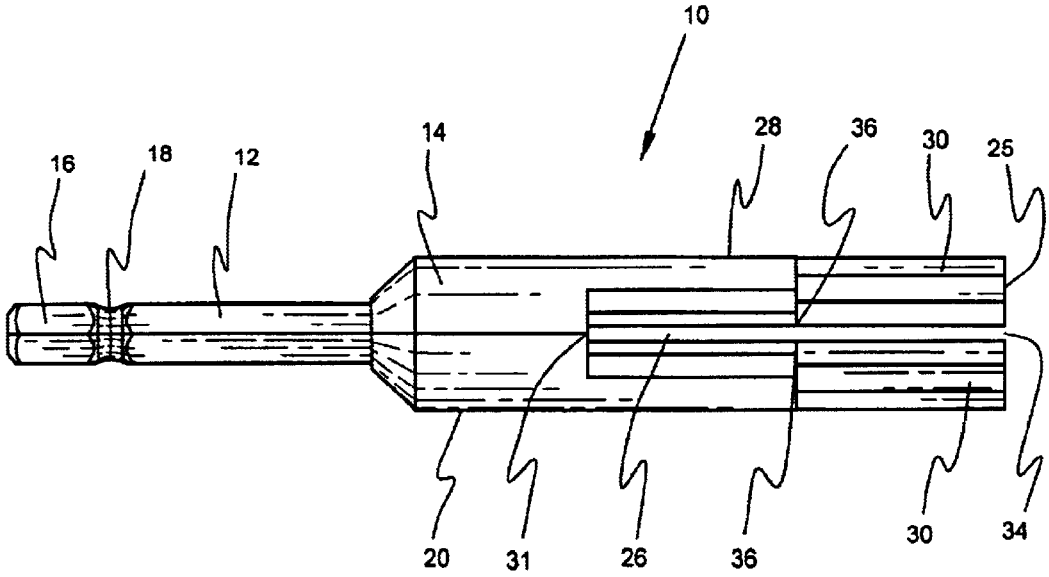
FIG. 2 is a front elevation view of the device of FIG. 1.
Figure 3:
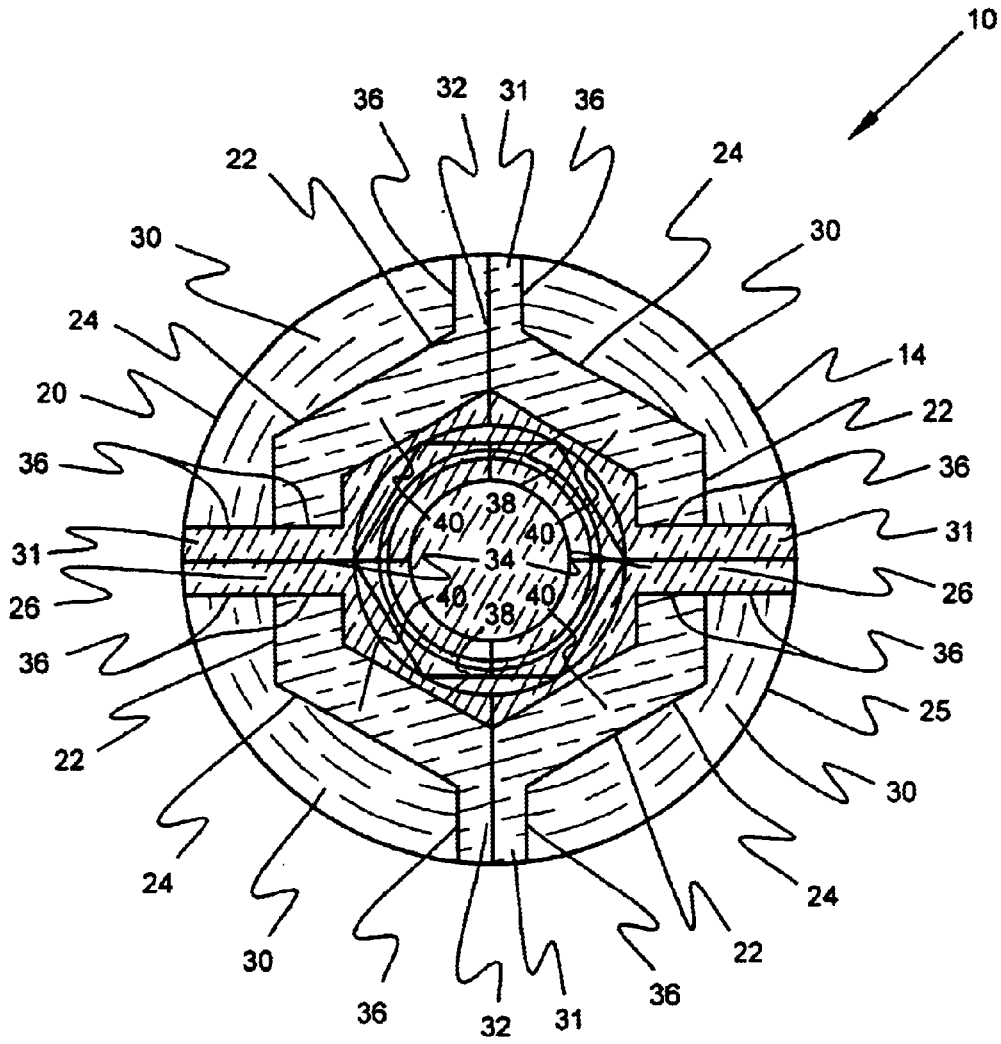
FIG. 3 is a side elevation view of the device of FIG. 1.

Referring now to the figures and in particular to FIGS. 1–3, perspective, front and side elevation views of a multi-functional fastener driver in accordance with the present invention is denoted by numeral 10. The multi-functional fastener driver device 10 is a single piece tool fabricated from steel or similar strength material pursuant to manufacturing techniques well known to those of ordinary skill in the art. The driver 10 receives rotary motion from a manual or power driver source (not shown), and transfers the rotary motion to a fastener (not shown). The fastener may range in size and configuration from a relatively small hook screw to a relatively large flathead fastener.

The multi-functional fastener driver device 10 includes a first portion 12 integrally joined to second portion 14. The first portion 12 has a hexagonal configuration (when taking a side view of the device 10) and a longitudinal dimension substantially longer than a corresponding lateral dimension, thus providing a shank portion 16 that includes a detent 18 for ultimate insertion into the chuck of a power tool, or the socket of a manual driver that provides rotary motion.

The second portion 14 includes a cylindrical outer wall 20, a hexagonally configured (when taking a side view of the second portion 14) inner wall 22 that forms a hexagonal fastener receiving aperture 24 extending coaxially with the cylindrical outer wall 20 from a fastener receiving end 25, a longitudinal distance substantially near a mid-section 28 of the second portion 14, and four recesses 26 extending parallel to the longitudinal axis of the second portion 14 to form four spaced apart arm members 30 having four fastener head engagement walls 31 there between.

The hexagonal fastener receiving aperture 24 has a predetermined cross-sectional area that snugly receives a correspondingly configured fastener head. Although the preferred aperture 24 configuration is hexagonal, alternative aperture 24 configurations including square and triangular may be utilized. The four recesses are equally spaced apart such that adjacent recesses are radially separated or offset ninety degrees thereby oppositely positioning two of the four recesses to form radial slots 32 and 34 (although the slots 32 and 34 may be radially aligned or radially offset other than ninety degrees should the fastener design require a different offset parameter) that cooperate with the receiving aperture 24 to allow a flathead fastener to be inserted in one of the slots 32 or 34. Obviously, the second portion 14 is capable of receiving only one preselected fastener in either the receiving aperture 24 or a radial slot 32 or 34. Thus, the second portion 14 is multi-functional because it is capable of receiving a wide variety of fasteners.

However, the second portion 14 has a tendency to flex and deform when transferring a rotational force to a fastener due to the spacing between the arm members 30. Also, the distance separating inner and outer walls 22 and 20, which determines the lateral thickness and corresponding rigidity of the arm members 30, is an important parameter effecting the degree of deformation of the second portion 14. More specifically, arm members 30 having shorter longitudinal dimensions and greater lateral thickness, will have less flexure and deformation when transferring rotational forces to a fastener inserted therein. Thus, more rotational force is transferred to the fastener.

The multi-functional capabilities of the present device 10 is enhanced by varying the dimensions or the axial alignment of the two slots 32 and 34. The slots 32 and 34 can vary in both longitudinal and lateral dimensions thereby allowing different sizes of flathead fasteners to be received by the second portion 14. Further, the slots 32 and 34 can be axially aligned with different lateral dimensions thus forming a "nested" slot configuration. An extra benefit provided by minimizing the longitudinal dimension of slot 32, is that the corresponding portions of the arm members 30 adjacent to slot 32, will be more resistant to deformation when transferring rotational force to the inserted fastener. Besides varying the longitudinal and lateral dimensions of the slots to decrease deformation of the second member 14 and the arm members 30, deformation is further reduced by providing a taper to the inner longitudinal walls 36 forming the slots 32 and 34. The tapered walls 36 converge as a fastener head inserts into the slots 32 and 34 until the fastener head ultimately engages both longitudinal walls 36; compared to parallel inner longitudinal walls 36 that allow the fastener head to contact engagement walls 31. The tapered walls 36 provide a method of continuously transferring rotary motion from the second portion 14 to a flathead fastener due to the continuous engagement between the tapered walls 36 and the fastener head; compared to parallel inner longitudinal walls 36 that allow gaps to occur between the fastener head and the parallel walls 36 resulting in unstable rotary force transfer.

The multi-functional driver device's 10 capabilities are further enhanced by including a "nested" hexagonal aperture 38 coaxial with the receiving aperture 24. The nested aperture 38 has substantially the same hexagonal configuration as the receiving aperture 24, but the nested aperture 38 has relatively smaller corresponding dimensions. This nested arrangement results in a rim wall 40 formed at the bottom of the receiving aperture 24. The rim wall 40 not only acts as a stop for the hexagonal head of a fastener inserted in the receiving aperture 24, but also provides added lateral thickness to corresponding portions of arm members 30 adjacent thereto. The added lateral thickness decreases arm member 30 flexure when transferring rotary force to fasteners.

Figure 4:
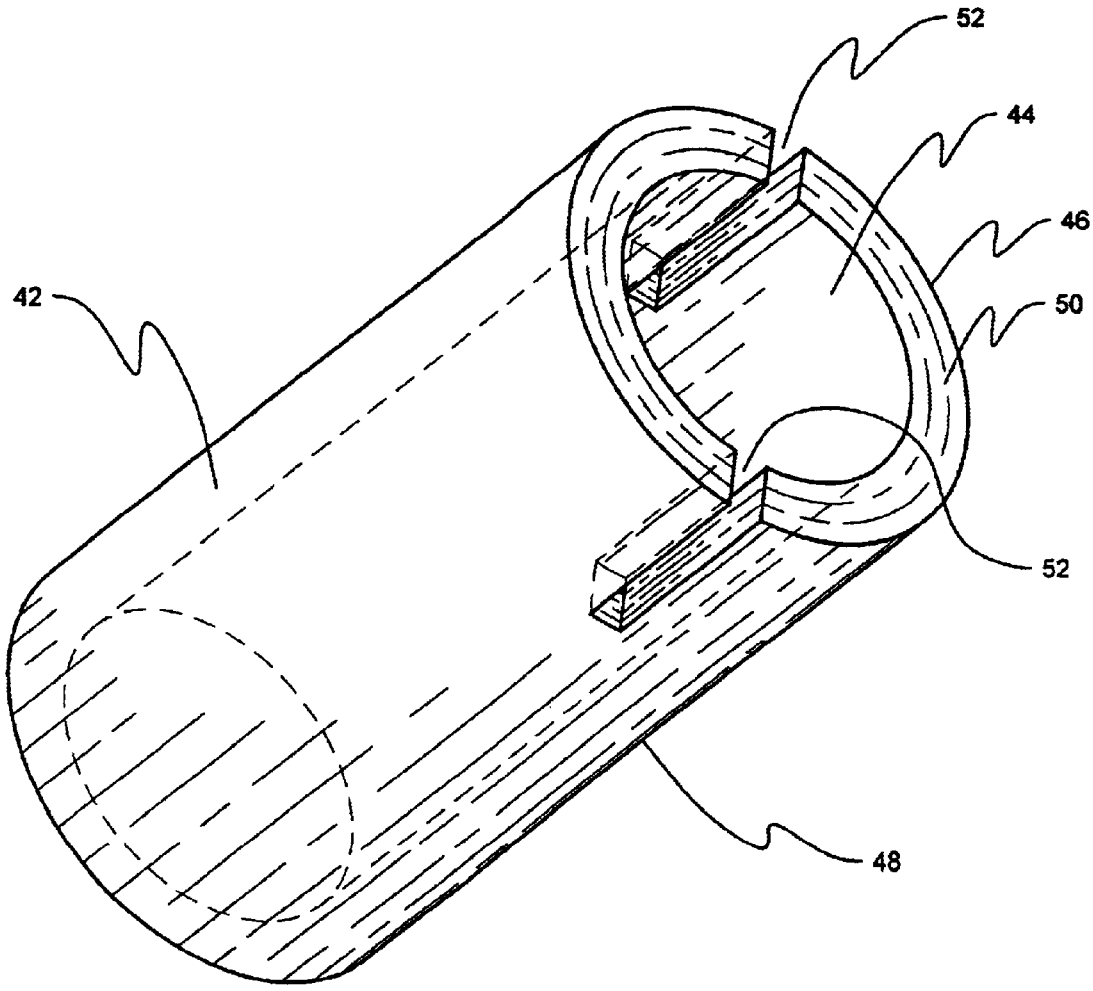
FIG. 4 is a phantom, front perspective view of a sleeve that receives a multi-functional fastener driver device therein in accordance with the present invention.
Figure 5:
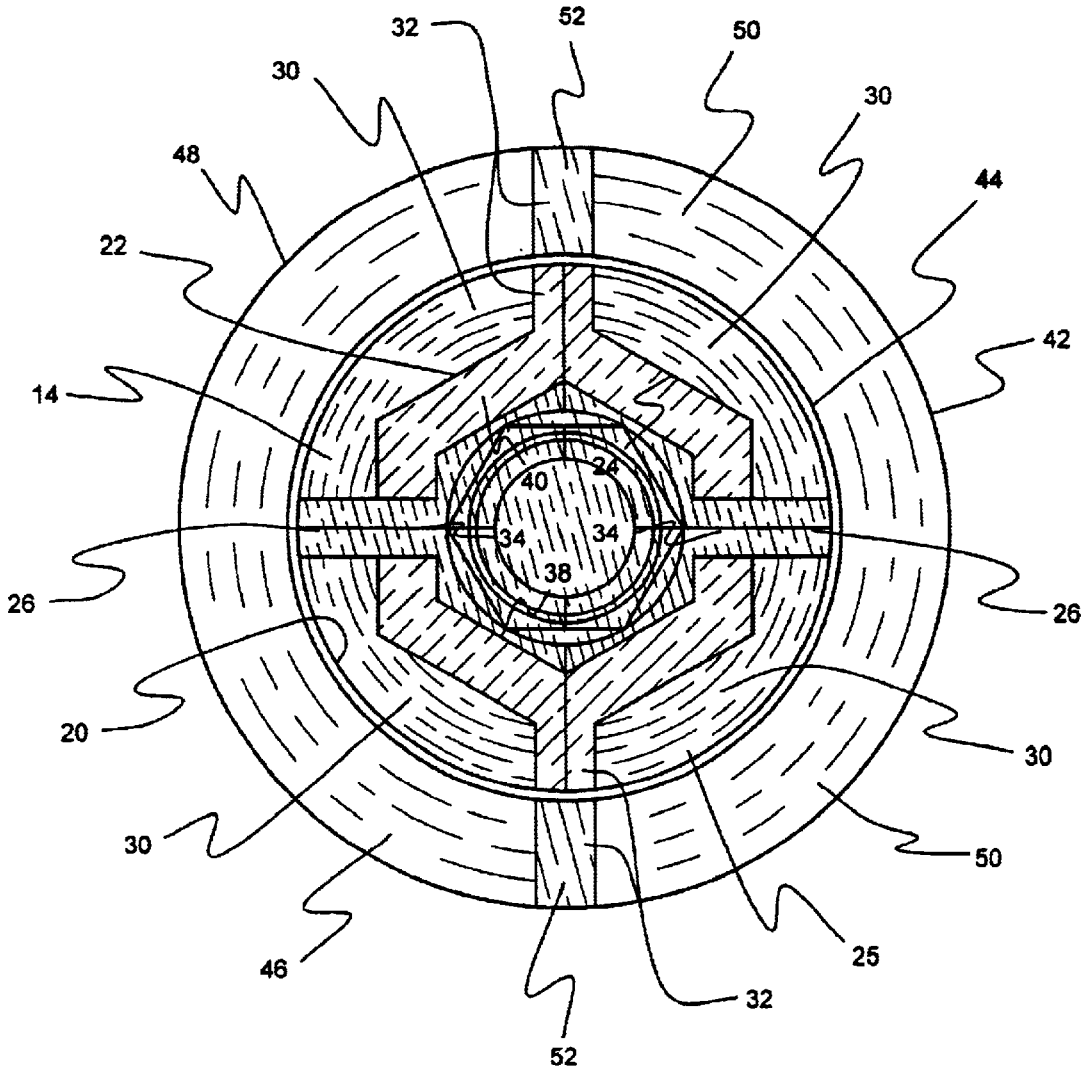
FIG. 5 is a side elevation view of the device of FIG. 1 inserted in the sleeve of FIG. 4.
Figure 5A:
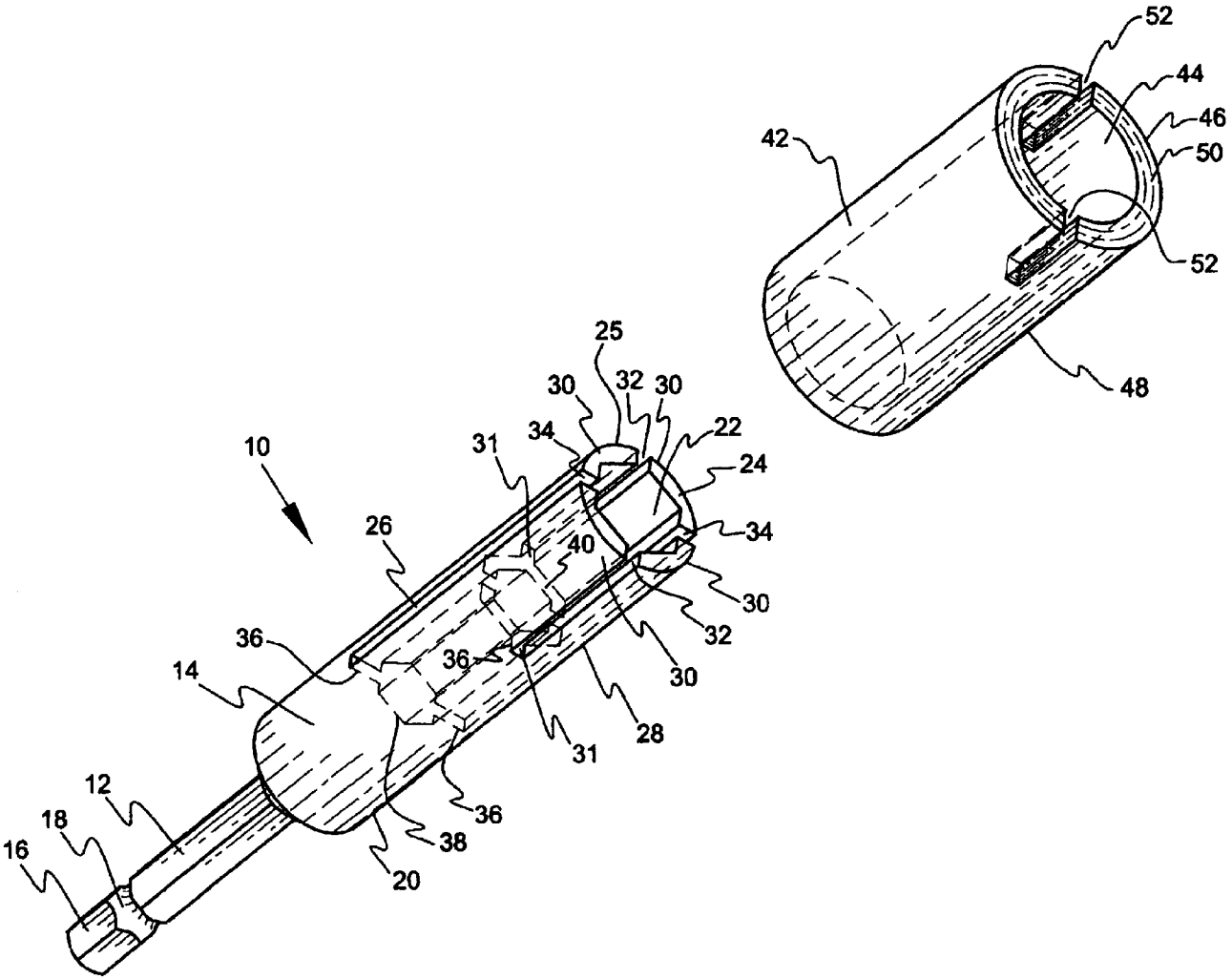
FIG. 5A is a combination of FIGS. 1 and 4 orientating the sleeve of FIG. 4 for receiving the device of FIG. 1.
Figure 6:
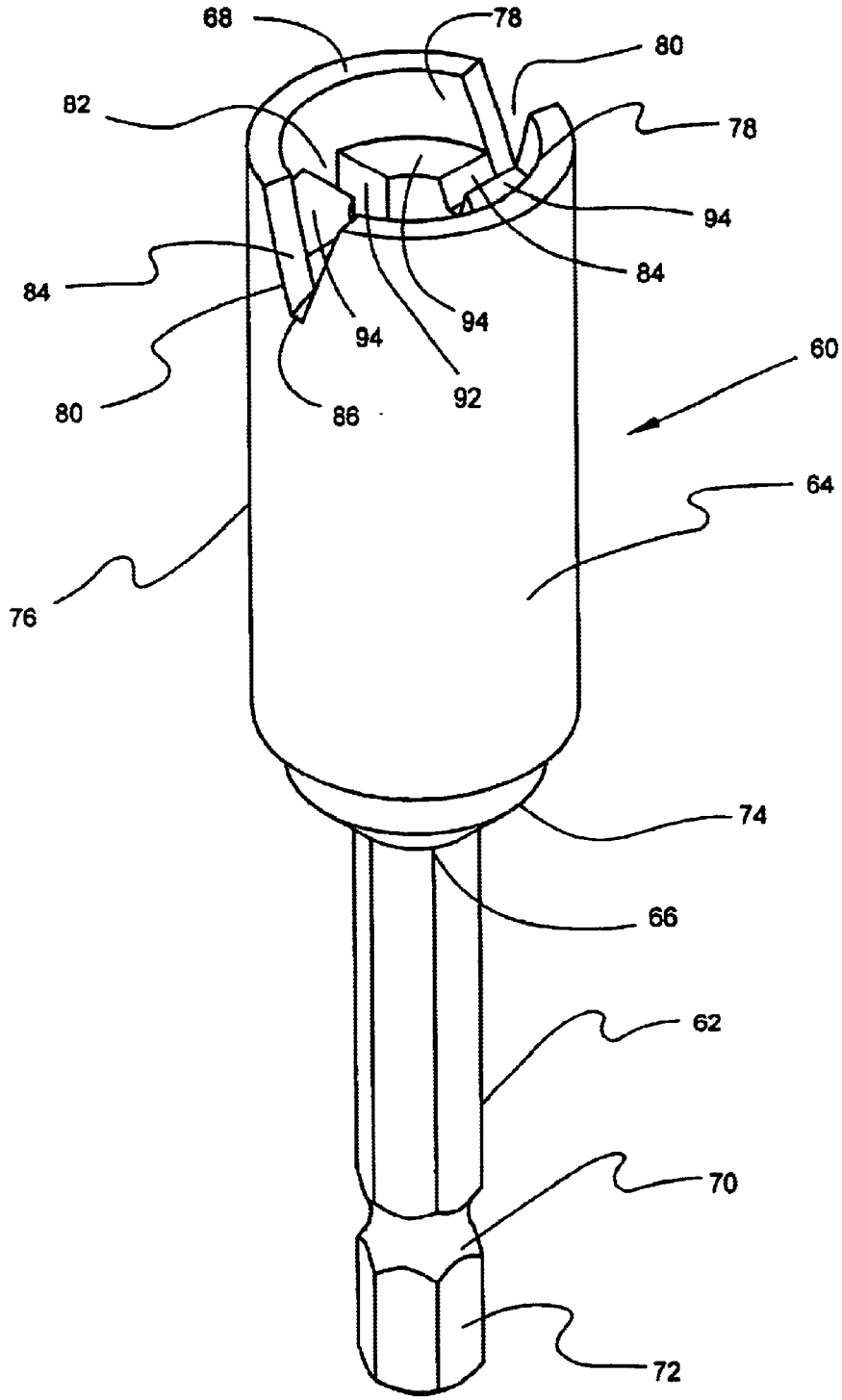
FIG. 6 is a perspective view of a multi-functional wingnut fastener driver device in accordance with the present invention.
Figure 7:
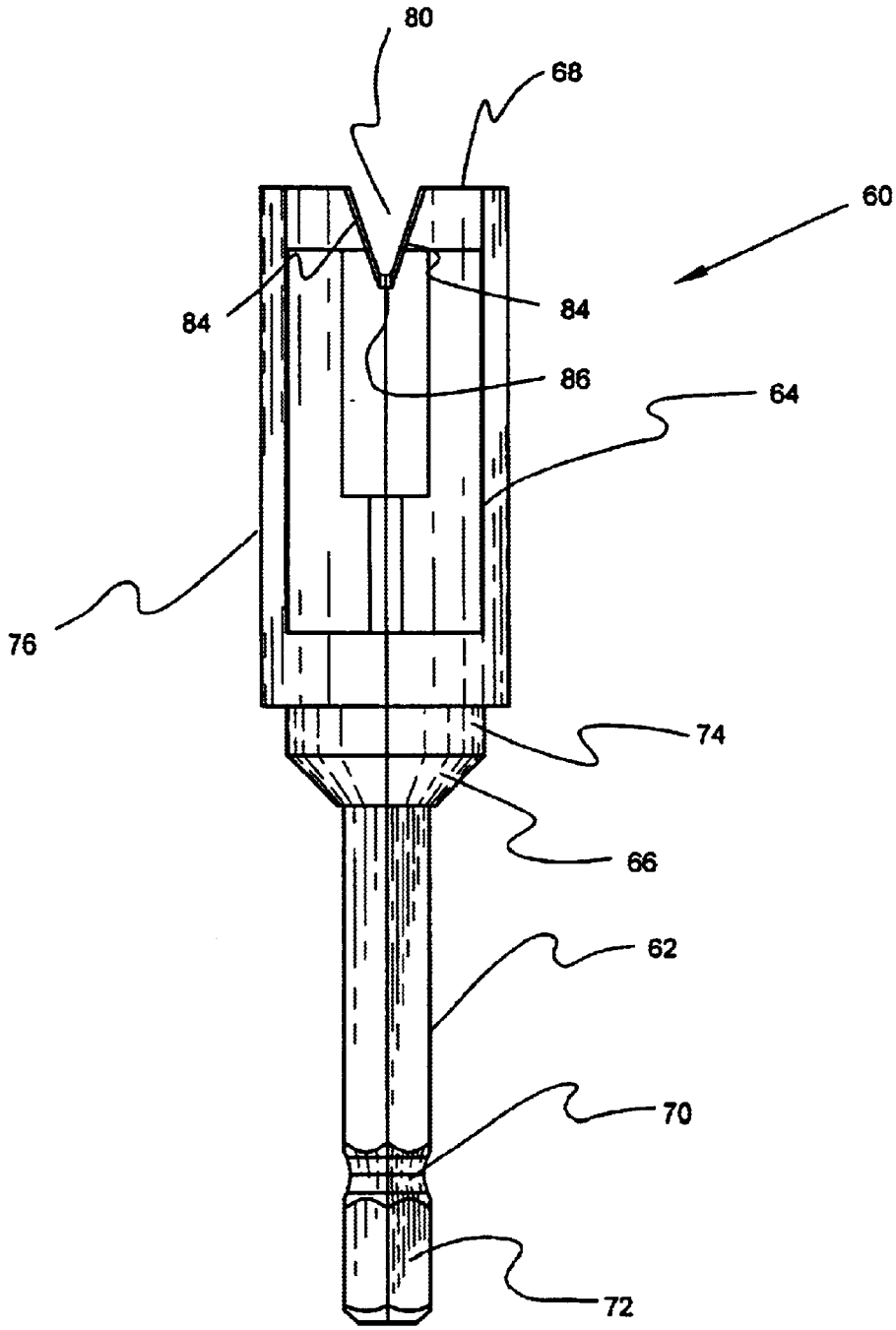
FIG. 7 is a front elevation view of the device of FIG. 6.
Figure 8:
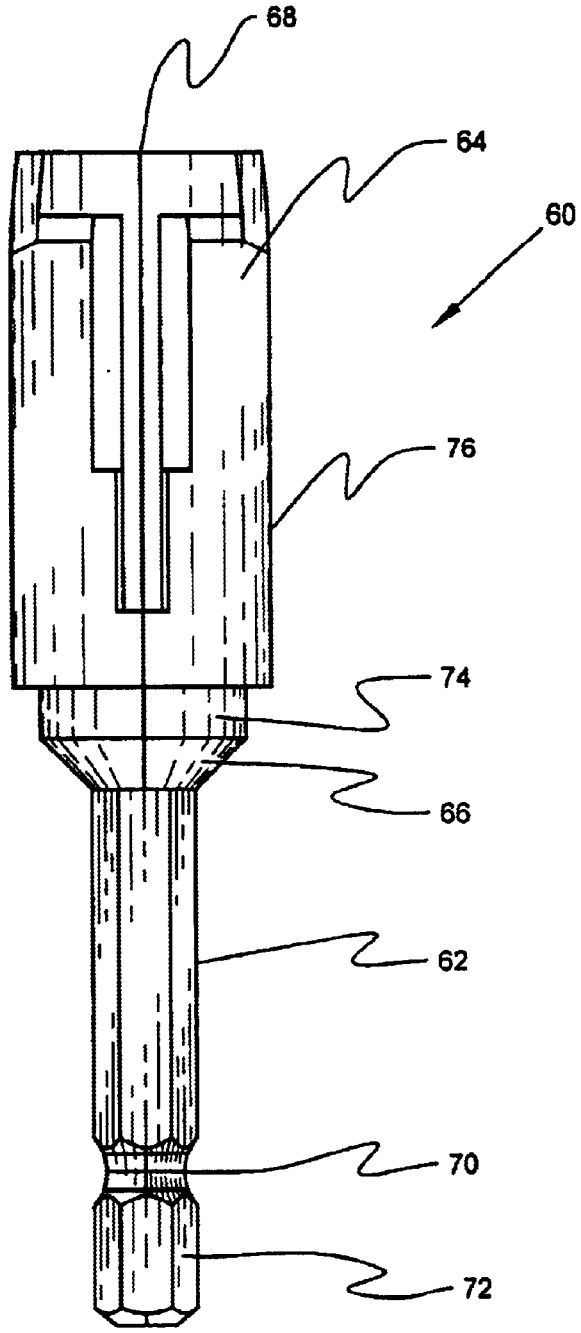
FIG. 8 is a side elevation view of the device of FIG. 6.
Figure 9:
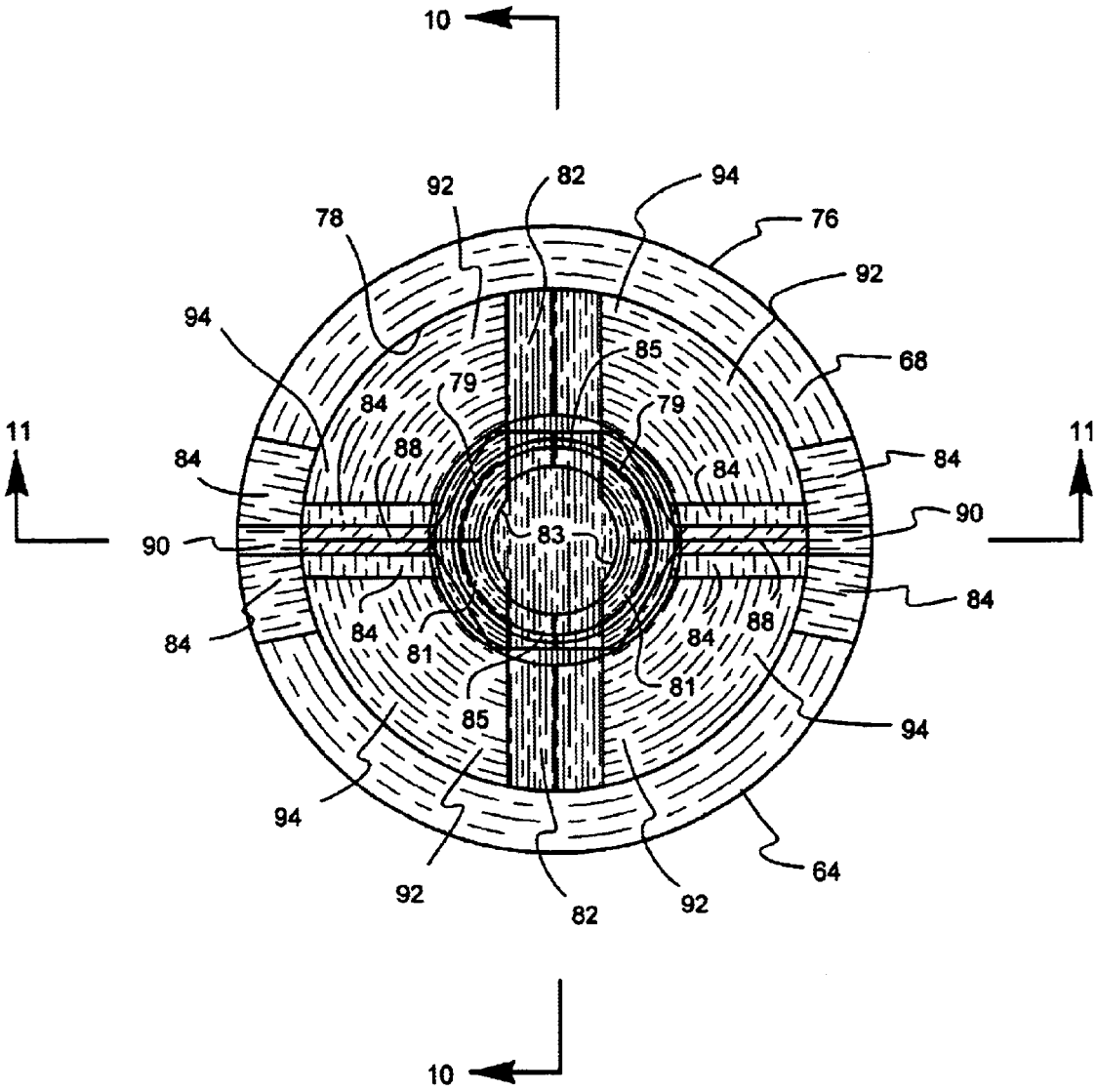
FIG. 9 is a top elevation view of the device of FIG. 6.
Figure 10:
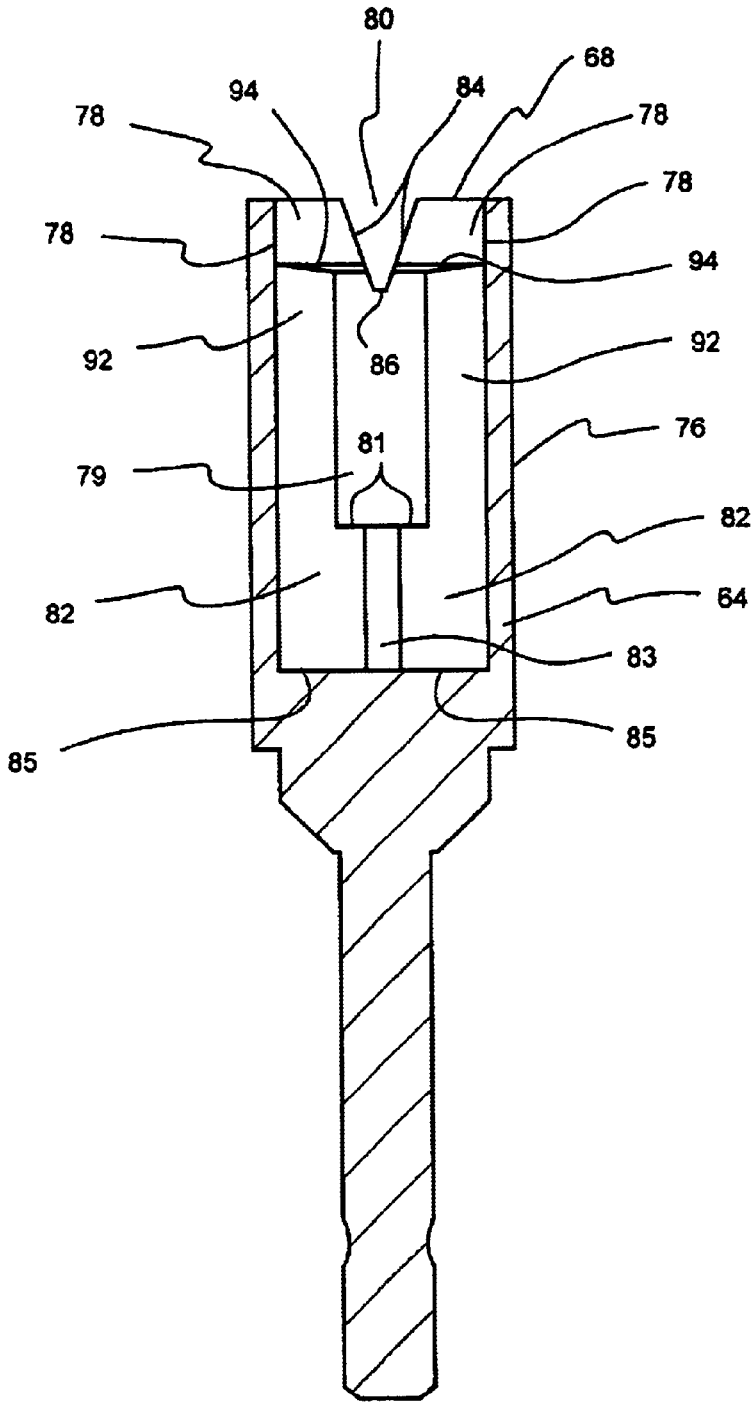
FIG. 10 is a sectional view taken along line 10—10 of FIG. 9.
Figure 11:
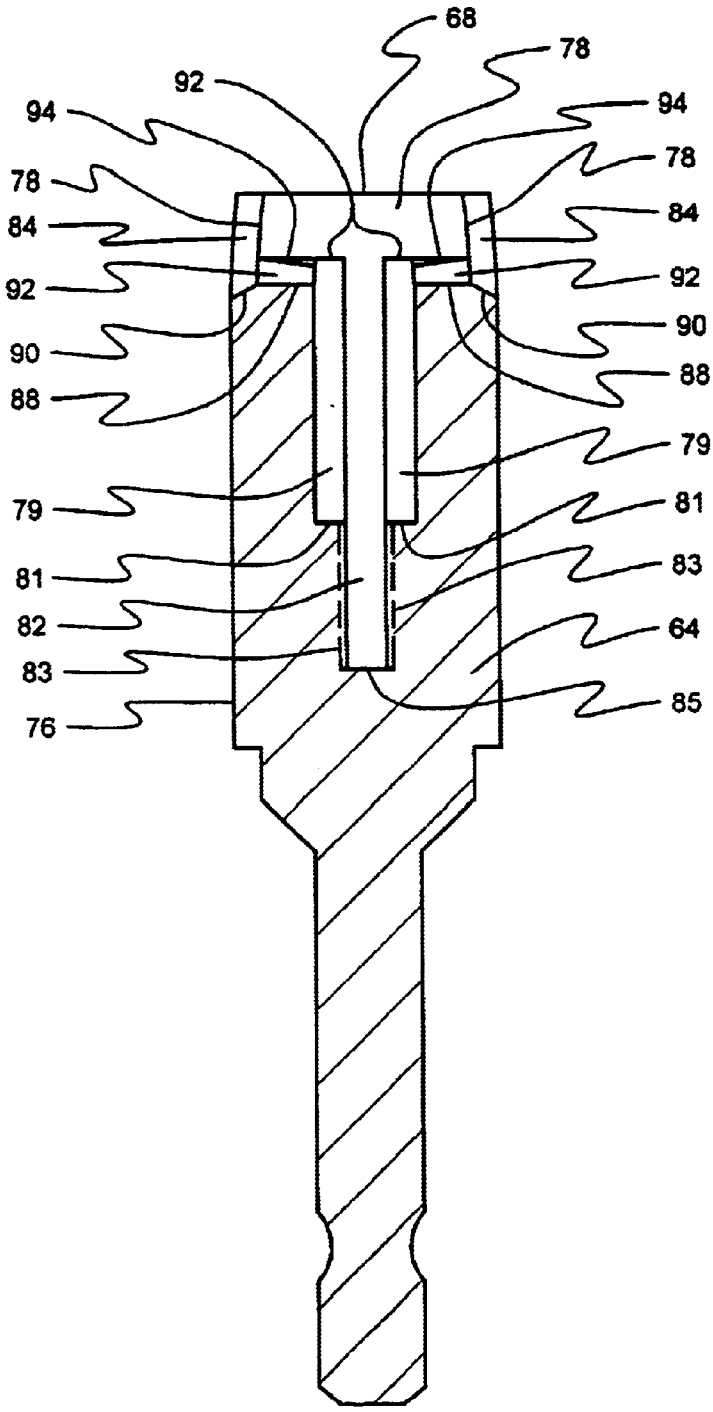
FIG. 11 is a sectional view taken along line 11—11 of FIG. 9.
Figure 12:
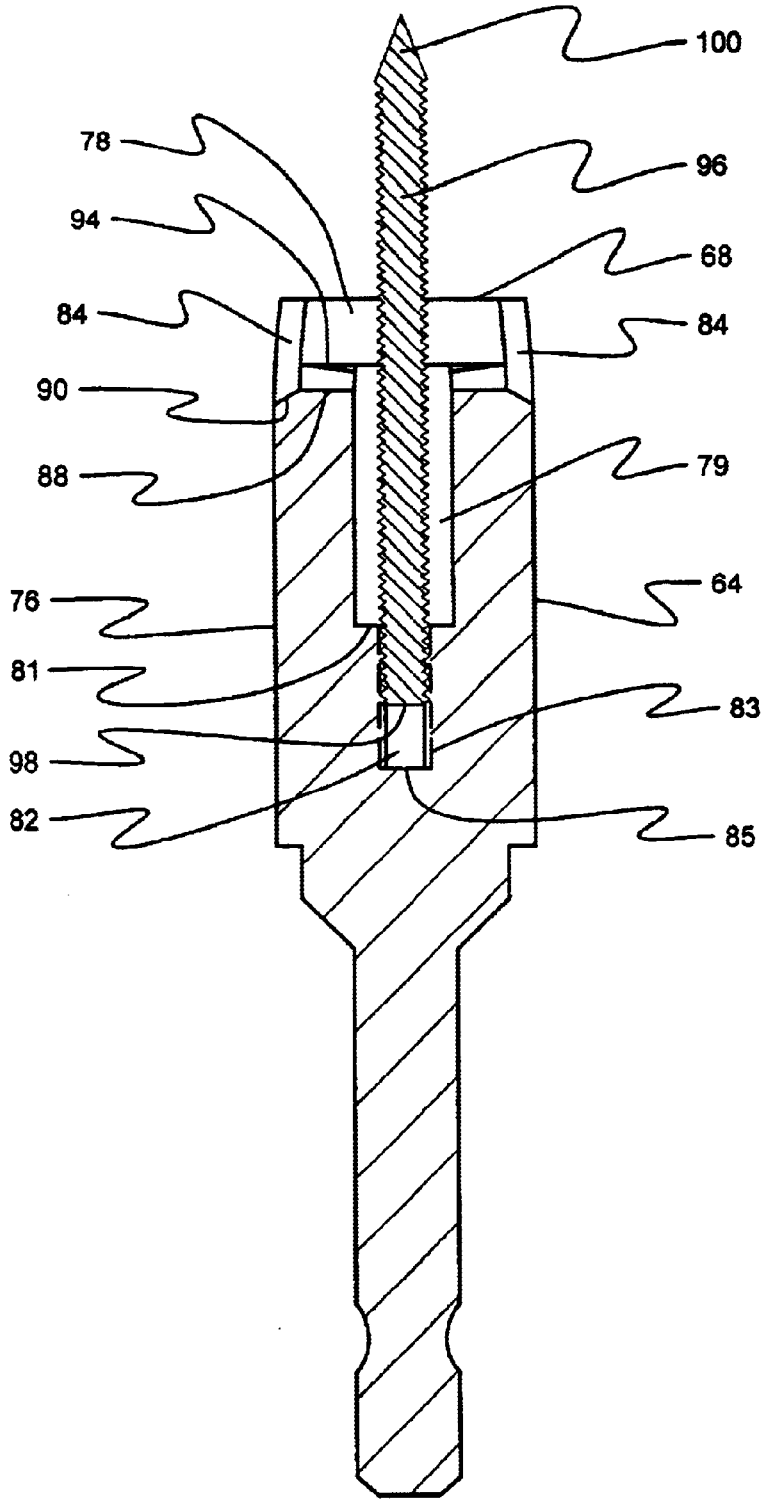
FIG. 12 is the sectional view of the device of FIG. 11 with a stud bolt screwed into a second orifice.

Referring now to FIGS. 4 and 5, the installation of some of the large fasteners requires a great amount of rotational force to drive the fastener into a workpiece. In these situations, the second portion 14 will deform to unacceptable configurations irrespective of the design of the device 10. To prevent this degree of deformation, a cylindrical outer sleeve 42 having an inner wall 44 substantially equal in diameter to and coaxially with the outer wall 20 of the second portion 14, forcibly receives the second portion 14 such that the fastener receiving end 25 of the second portion 14 is planar or "flush" with a corresponding receiving end 46 of the sleeve 42. The sleeve 42 includes a cylindrical outer wall 48 having a diameter relatively larger than the diameter of the inner wall 44 thereby preventing deformation of the second member 14 and providing sufficient surface area to form an end wall 50 that allows a pair of opposing recess 52 to be positioned adjacent to one of the slots 32 or 34 in the receiving end 25 in the second member 14.

The recesses 52 extend parallel to the longitudinal axis of the sleeve 42, a distance relatively short compared to the longitudinal extension of the slots 32 and 34. The recesses 52 have a lateral dimension equal to the lateral dimension of one of the slots 32 or 34. The recesses 52 are positioned adjacent to one of the slots 32 or 34 thereby expanding the longitudinal dimension of the chosen slot 32 or 34 to substantially equal the diameter of the outer wall 48 of the sleeve 42 thus allowing a much larger fastener head to be engaged and rotated by the combined second portion 14 and sleeve 42.

In operation, a first portion 12 of a multi-function fastener driver device 10 is secured to a manual or powered rotary driver tool via a shank portion 16. A fastener having a predetermined configuration is inserted in correspondingly configured hexagonal apertures 24 or 38, or slots 32 or 34 in the second portion 14 which is integrally joined to the first portion 12. Rotary motion is transferred from the rotary driver tool to the fastener via arm members 30 thereby providing sufficient rotational force to urge the fastener into a workpiece.

A sleeve 42 is provided to snugly receive the device 10 therein to prevent the arm members 30 from deforming should the selected fastener be relatively large and require excessive rotational force to drive the fastener into the workpiece. The sleeve 42 includes a rim or end wall 50 that is planar with the fastener receiving end 25 of the second portion 14. The end wall 50 of the sleeve 42 includes opposing recesses 52 that are positioned adjacent to either slot 32 or 34 to lengthen the chosen slot thereby providing more engagement area between the large fastener and the combined device 10 and sleeve 42, thus transferring the rotational force across a larger portion of the fastener head and reducing wear on the device 10 and sleeve 42.

Referring now to FIGS. 6–9, perspective, front, side and top elevation views depict a multi-functional wingnut fastener driver device 60 in accordance with the present invention. The wingnut fastener driver device 60 is an alternative embodiment of the multi-functional fastener driver device 10 detailed above. The wingnut device 60 includes a first or shank portion 62, a second or cylindrical portion 64, and a frustoconically configured middle portion 66 that integrally joins the shank portion 62 to the cylindrical portion 64 whereby the rotational force imposed upon the shank portion 62 is transferred to a fastener end or drive end 68 of the cylindrical portion 64.

The shank portion 62 is hexagonally configured and includes a detent 70 and cooperating end portion 72 that ultimately insert into a rotary tool. The shank portion 62 is laterally and longitudinally dimensioned to insert in a standard rotary tool such that the middle and cylindrical portions 64 and 66 are positioned adjacent to the rotary tool, yet avoid communication with the rotary tool, thus providing safety and maximum rotary force.

The middle portion 66 is coaxial with and integrally joined to the shank portion 62, and includes a cylindrical section 74 coaxial with integrally joined to the cylindrical portion 64 of the device 60. The diameter of the cylindrical section 74 is relatively larger than the lateral dimension of the shank portion 62, and relatively smaller then the diameter of the cylindrical portion 64 thereby allowing the device 60 to drive a wingnut having dimensions relatively larger than the drive end of the rotary tool.

The cylindrical portion 64 includes a cylindrical outer wall 76 extending longitudinally from the middle portion 66 to the drive end 68, a cylindrical inner wall 78 coaxial to the outer wall 76 and extending a relatively short axial distance from the drive end 68, a first orifice 79 coaxial to the inner wall 78 extending an axial distance that positions a bottom wall 81 of the first orifice 79 proximate to the longitudinal mid-portion of the cylindrical portion 64, a second non-tapered or straight threaded orifice 83 coaxial to the first orifice 79 and extending from the bottom wall 81 of the first orifice 79 to a longitudinal position substantially adjacent to the middle portion 66 of the device 60, an outer tapered recess 80 extending transversely across the drive end 68 of the cylindrical portion 64 and to a "depth" dimension relatively longer than the axial length of the inner wall 78, and an inner rectangular configured recess 82 extending diametrically across the drive end 68 and radially displaced from the outer recess 80.

Figure 13:
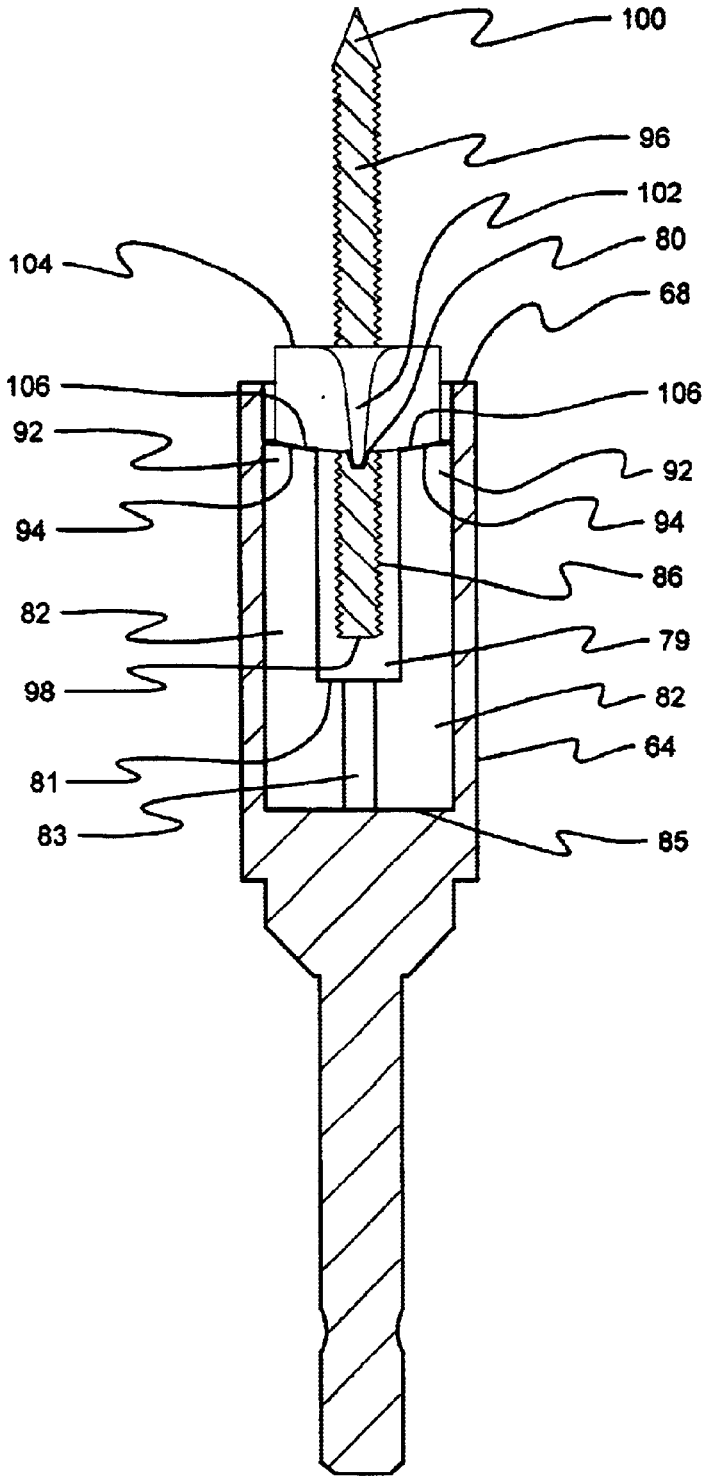
FIG. 13 is the sectional view of the device of FIG. 10 with a wingnut inserted in an outer recess such that the "wings" of the wingnut engage a base wall of the outer recess.
Figure 14:
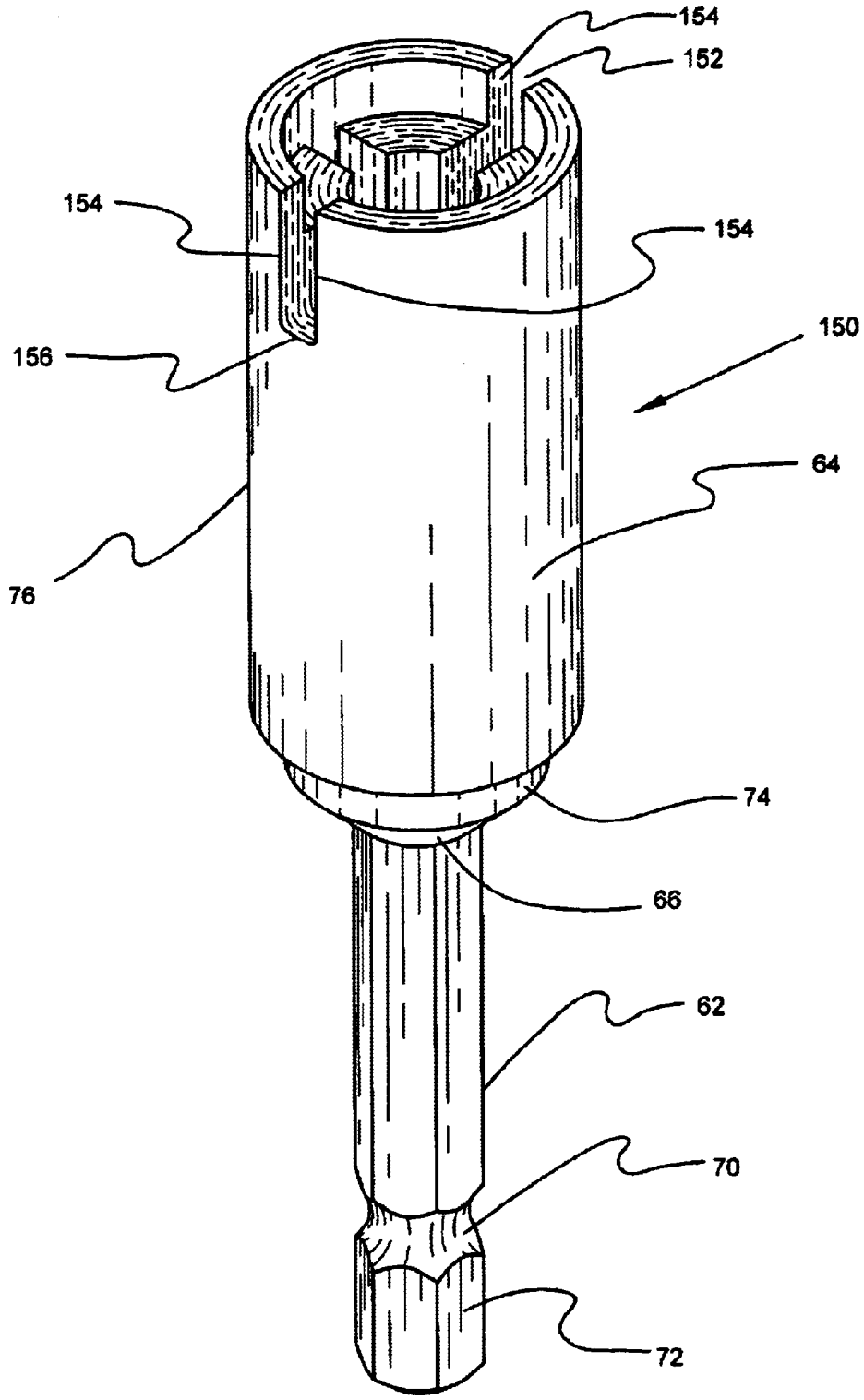
FIG. 14 is a perspective view of an alternative embodiment of the multi-functional wingnut fastener driver device of FIG. 6 in accordance with the present invention.
Figure 15:
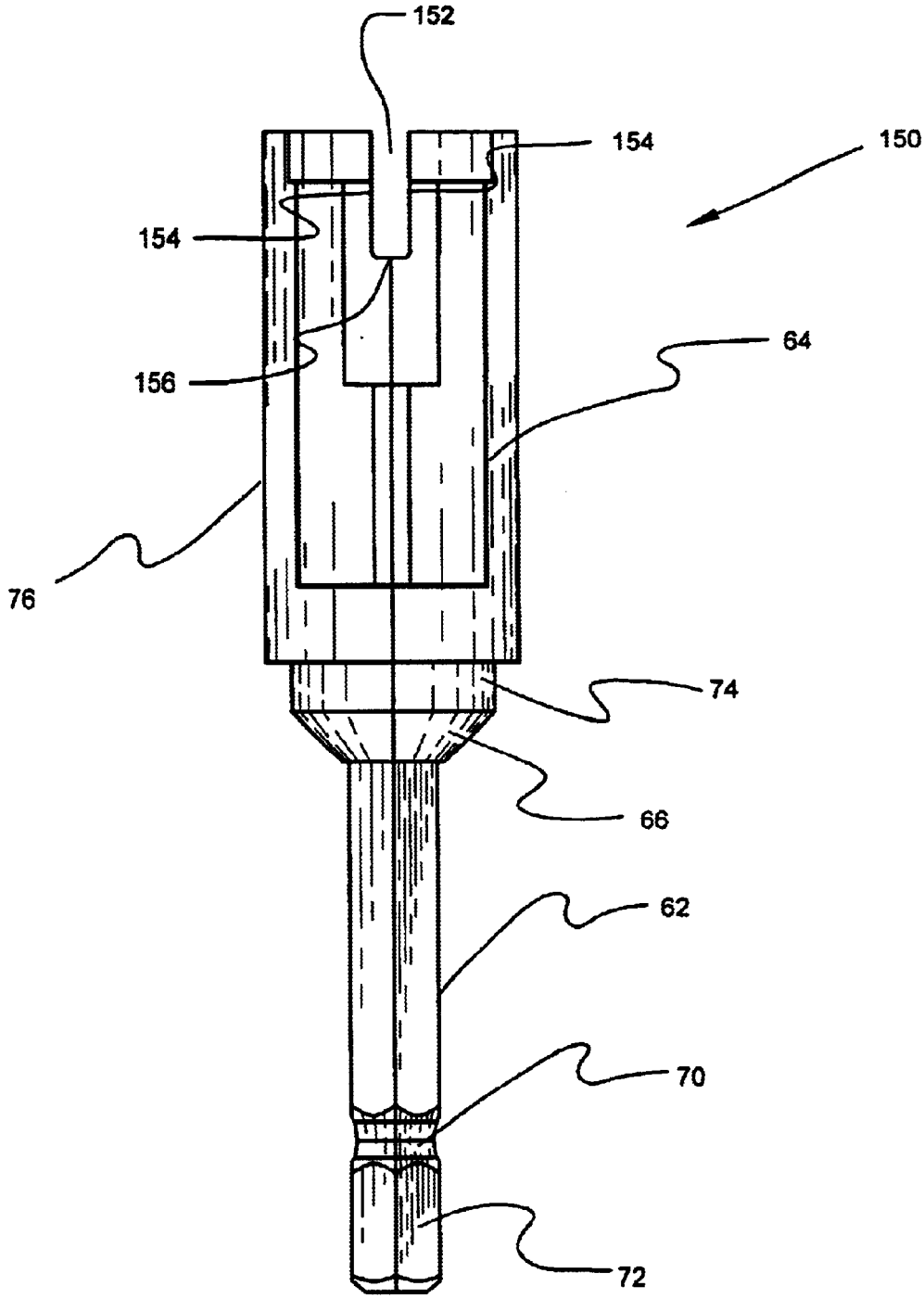
FIG. 15 is a front elevation view of the device of FIG. 14.
Figure 16:
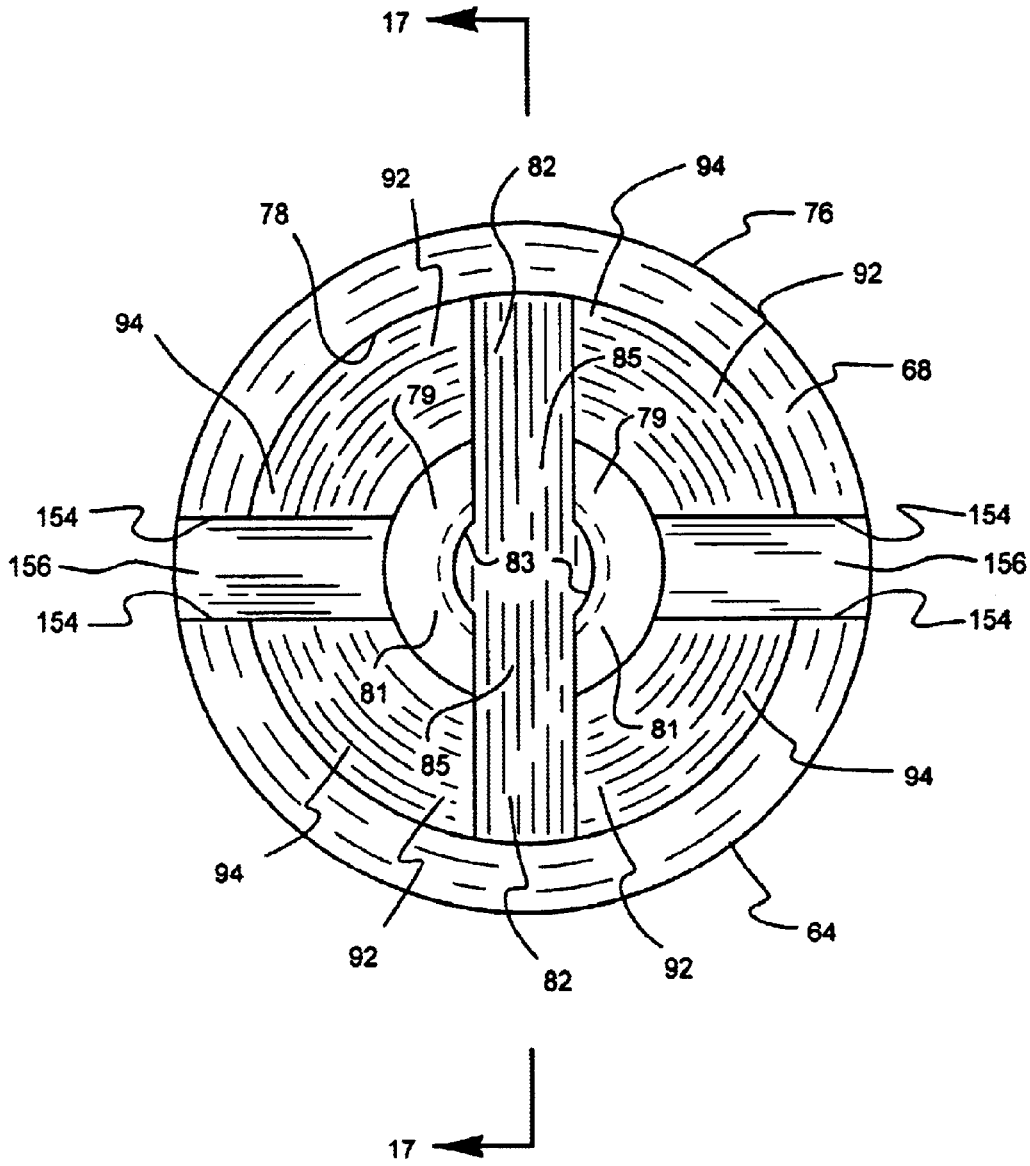
FIG. 16 is a top elevation view of the device of FIG. 14.
Figure 17:
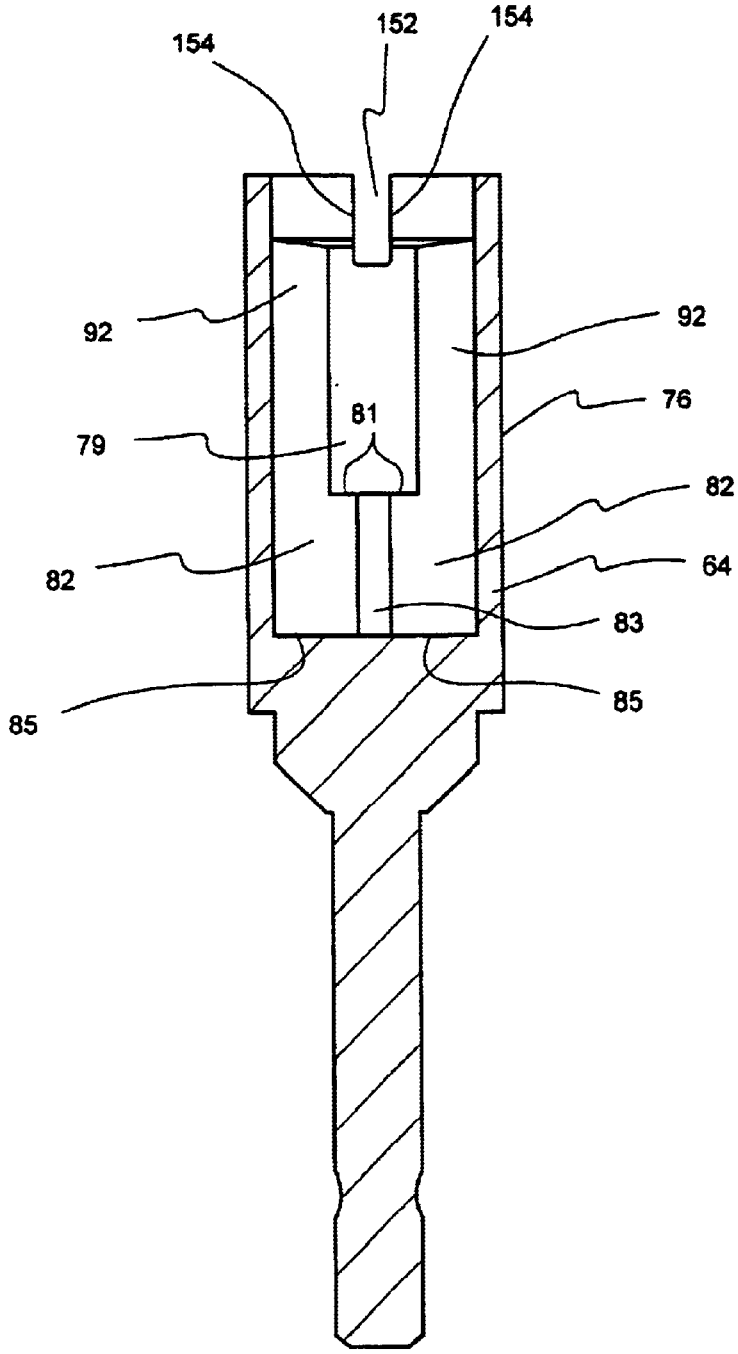
FIG. 17 is a sectional view taken along line 17—17 of FIG. 16.

The outer tapered recess 80 is substantially "V" shaped (when taking a front view of the device 60—see FIG. 7) with relatively "steep" converging side walls 84 that extend from the drive end 68 to a base wall 86. The side walls 84 receive the "wings" 102 of the wingnut 104 to guide the wingnut 104 into snug engagement with the base wall 86 and converging side walls 84 (see FIG. 13). The base wall 86 has a relatively small lateral dimension in relation to its longitudinal dimension. The base wall 86 includes two sections separated by the first orifice 79, each section including inner and outer angularly joined planar portions 88 and 90 that engage corresponding portions of the wingnut. The inner portions 88 are opposing, planar, radially extending walls that are perpendicular to the axis of the cylindrical portion 64, and extend from the perimeter of the first orifice 79 to the outer portions 90 of the base wall 86. The outer portions 90 integrally join to corresponding inner portions 88 and the outer wall 76 of the cylindrical portion 64 such that a relatively large acute angle is formed between the cylindrical inner wall 78 and the outer portions 90 of the base wall 86. The inner portions 88 engage corresponding planar portions of the wings 102 of the wingnut 104 while the outer portions 90 engage corresponding arcuate portions of the wings 102 thereby providing multiple contact points between the device 60 and the wingnut 104 to transfer rotary motion from the device 60 to the wingnut 104 without deforming the wings 102. Although the outer portions 90 have been detailed above as being "planar," the outer portion configuration may be arcuate to enhance engagement with the arcuate portions of the wings 102 of the wingnut 104. The transfer of rotary motion is further increased by adding "gripping" capability in the form of knurled surfaces upon the side and base walls 84 and 86 of the outer recess 80.

Referring to FIGS. 6, 9, 10, 11, 12 and 13, the rectangular inner recess 82 is radially displaced substantially about ninety degrees from the outer tapered recess 80, thus allowing the device 60 to not only receive and rotate wingnut fasteners, but also to rotary drive the flathead and hook screw fasteners detailed above. The inner recess 82 extends diametrically across the drive end 68 to integrally join with the cylindrical inner wall 78 and the first and second orifices 79 and 83. The inner recess 82 cooperates with the outer recess 80 and the first orifice 79 to configure four hub engagement sectors 92 that are displaced from the drive end 68 of the cylindrical portion 64. Each hub engagement sector has a concave hub engagement surface 94 that congruently engages a corresponding hub portion 106 of the wingnut 104 to stabilize the wingnut 104 as the device 60 transfers rotary motion to the wingnut 104 via the outer recess 80 engaging and rotating the wings 102 of the wingnut 104. The first orifice 79 has a diameter relatively larger than that of a preselected stud bolt 96 that is to be anchored into a first workpiece (not shown) to ultimately receive and secure a second workpiece (not shown) thereto. The stud bolt 96 has a first end 98 that passes through the first orifice 79 and threads into the straight threaded second orifice 83, which is longitudinal "nested" inside the first orifice 79, to rigidly secure the bolt 96 to the device 60. The second orifice 83 is dimensioned to rotationally receive the correspondingly threaded first end 98 of the stud bolt 96. The secured stud bolt 96 has a second end 100 that protrudes beyond the drive end 68 of the device 60, a dimension that allows the second end 100 to be inserted into the first workpiece a depth that rigidly secures the bolt 96 to the first workpiece. The second orifice 83 allows the device 60 to rotatably drive the threaded second end 100 of the stud bolt 96 into the first workpiece until the stud bolt 96 is secured and anchored thereto. Once the stud bolt 96 is secured, reversing the rotation of the device 60 easily detaches the device 60 from the bolt 96 due to the non-binding characteristics of the straight thread of the second orifice 83.

The stud bolt 96 ultimately inserts through an orifice in the second workpiece whereupon a wingnut is hand tightened on the bolt 96. The device 60 is positioned upon the stud 96 such that the outer recess 80 of the device 60 receives the wings 102 of the wingnut 104 and the first orifice 79 receives the first end 98 of the bolt 96. The device 60 rotationally tightens the wingnut 104 until the second workpiece is rigidly secured to the first workpiece. Obviously, the longitudinal dimension of the first orifice 79 must be capable of receiving the longitudinal portion of the stud bolt 96 extending past the wings 102 of the tightened wingnut 104 thereby preventing obstructions to the longitudinal extension of the stud bolt 96 through the wingnut. Further, the longitudinal dimension of the second orifice 83 must be smaller than the axial dimension of the wingnut 104 to prevent the bolt 96 from re-inserting into the second orifice 83 upon tightening the wingnut 104 to secure the second workpiece to the first workpiece.

In operation, a multi-functional wingnut fastener device 60 is utilized to remove or tighten a wingnut 104 upon a stud bolt 96. Also, the device 60 is capable of forcibly driving the bolt 96 into a workpiece. To anchor the stud bolt in the workpiece, the bolt 96 is screwed into a straight threaded second orifice 83 via the drive end 68 of the device 60 such that a portion of the stud 96 protrudes beyond the drive end 68. The device 60 is removably secured to a rotary motion tool and the protruding bolt 96 is driven into the workpiece. Once the bolt 96 is secured, the device 60 is removed from the bolt 96 by reversing the rotational direction of the rotary tool. A wingnut 104 requiring loosening or tightening is engaged by the drive end 68 of the cylindrical portion 64 of the device 60. The stud bolt 96 loosely inserts into the first orifice 79 to a position proximate to the second orifice 83. The wingnut 104 snugly fits in the drive end 68 of the device 60 such that the wings 102 of the wingnut 104 engage both the converging side walls 84 and the base walls 86 of an outer recess 80 in the drive end 68; and the convex hub portion 106 of the wingnut 104 engages corresponding concave hub engagement surfaces 94 of hub engagement sectors 92 configured via the outer and inner recess 80 and 82 in the drive end 68 cooperating with the first orifice 79. The wingnut 104 is then either loosened or tightened to the required position without the bolt 96 inserting into the second orifice 83. Once the wingnut 104 is rotated to the required positioned, the device 60 is easily removed from the wingnut 104 and stud bolt 96.

Referring now to FIGS. 14–17, an alternative or modified embodiment of the multi-functional wingnut fastener driver device 60, is illustrated and denoted as numeral 150. The modified wingnut fastener driver device 150 is substantially identical to the original device 60 except that the tapered recess 80 of the original device 60 has been replaced by a rectangular recess 152 (see FIG. 15) having parallel longitudinal side walls 154 substantially longer than and perpendicular to a bottom wall 156. The rectangular recess 152 is dimensioned to snugly receive the wings 102 of the wingnut 104 (see FIG. 13), and to provide an increased area of engagement between the wings 102 and the side walls 154 thereby preventing the wings 102 from deforming when increasing the quantity of rotary motion urged upon the wingnut 104 to rigidly secure relatively large objects together. To further promote the transfer of rotary motion from the device 150 to the wingnut 104, and to reduce lateral movement of the device 150 relative to the wingnut 104, the bottom wall 156 of the device 150 may be configured to congruently engage a corresponding portion of the wings 102 thus stabilizing the proximate position of the device 150 relative to the wingnut 104 as the wingnut 104 is tightened upon or removed from a threaded stud bolt 96 (see FIG. 13).

The foregoing description is for purposes of illustration only and is not intended to limit the scope of protection accorded this invention. The scope of protection is to be measured by the following claims, which should be interpreted as broadly as the inventive contribution permits.

What is claimed is:

1. A multi-functional fastener device comprising:

a first portion having means for receiving rotary motion; and a second portion integrally joined to said first portion;

said second portion having means for transferring rotary motion to a fastener, said rotary motion transferring means further comprising:

a hexagonal configured aperture extending longitudinally from a fastener receiving end of said second portion;

a pair of opposing first slots for receiving a fastener having first dimensions, said pair of opposing first slots extending longitudinally from said fastener receiving end of said second portion;

a pair of opposing second slots for receiving a fastener having second dimensions, said pair of opposing second slots extending longitudinally from said fastener receiving end of said second portion; and a sleeve member having a pair of opposing slots that ultimately align with one of said pair of first or second slots of said second member.

2. The device of claim 1 wherein said rotary motion receiving means includes a shank having a hexagonal configuration.

3. The device of claim 1 wherein the longitudinal axis of said hexagonal aperture is co-axial with the longitudinal axis of said second portion.

4. The device of claim 1 wherein said first pair of slots are aligned when taking a front elevation view of said device.

5. The device of claim 1 wherein said first pair of slots are longitudinally parallel to and radially offset from said second pair of slots.

6. The device of claim 1 wherein said first pair of slots are radially offset ninety degrees from said second pair of slots.

7. The device of claim 1 wherein said first pair of slots have a longitudinal dimension relatively longer than the longitudinal dimension of said second pair of slots.

8. The device of claim 1 wherein said first pair of slots and said second pair slots have equal longitudinal dimensions.

9. The device of claim 1 wherein said first pair of slots form a substantially "V" configuration when taking a front elevation view of said device.

10. The device of claim 9 wherein said first pair of slots have a substantially equal width dimension to snugly receive a hook portion of a hook fastener.

11. The device of claim 1 wherein said first pair of slots have a substantially equal inner longitudinal wall dimension.

12. A fastener device comprising:

a first portion having means for receiving rotary motion;

a second portion integrally joined to said first portion, said second portion including a first aperture having means for receiving a first portion of a first fastener, a second aperture having means for receiving a first portion of a second fastener, and a pair of opposing slots that form arm members in said second portion; and a sleeve portion having a pair of opposing slots that ultimately align with said slots in said second portion, said aligned pairs of slots cooperating to transfer rotary motion to a fastener.

13. The device of claim 12 wherein said rotary motion receiving means includes a shank having a hexagonal configuration.

14. A fastener device comprising:

a first portion having means for receiving rotary motion;

a second portion integrally joined to said first portion, said second portion having means for transferring rotary motion to a fastener, said rotary motion transferring means comprising a first pair of slots dimensioned to snugly receive a first fastener having a predetermined configuration and a second pair of slots dimensioned to snugly receive a second fastener having a predetermined configuration; and a third portion snugly encasing said second portion to retain the configuration of said second portion, said third portion including a pair of slots that cooperate with one of said first or second pair of slots to transfer rotary motion to a fastener.

15. The device of claim 14 wherein said second portion further includes an aperture dimensioned to snugly receive a third fastener having a predetermined configuration.

16. The device of claim 15 wherein said aperture includes a hexagonal configuration, said hexagonal aperture extending a first longitudinal distance from a receiving end of said second portion.

17. The device of claim 16 wherein said second portion further includes a second hexagonal configured aperture extending a second longitudinal distance from said receiving end of said second portion, said second hexagonal aperture being nested inside said first hexagonal aperture.

18. The device of claim 14 wherein said second pair of slots are radially offset from said first pair of slots.

19. The device of claim 14 wherein said first pair of slots of said second portion include tapered inner walls that cooperatively engage the fastener when inserted in said first slot thereby continuously transferring rotary motion from said second portion to the fastener.

20. A multi-functional wingnut fastener device comprising:

a first portion having means for receiving rotary motion; and a second portion integrally joined to said first portion, said second portion having means for transferring rotary motion to a wingnut fastener, said rotary motion transferring means further comprising:

a tapered recess in a fastener end of said second portion;

a sleeve member having a pair of opposing slots that ultimately align with a pair of slots in said second portion; and means for engaging a hub portion of the wingnut, said hub engagement means cooperating with said recess to removably receive and rotate the wingnut whereby the wingnut is secured to or removed from a threaded bolt inserted in a threaded orifice in the hub portion of the wingnut.

21. The device of claim 20 wherein said first portion further includes a shank.

22. The device of claim 20 wherein said fastener end of said second portion further includes a rectangular configured recess radially displaced from said tapered wall recess.

23. The device of claim 22 wherein said radial displacement between said tapered recess and said rectangular configured recess is substantially about ninety degrees.

24. The device of claim 20 wherein said second portion further includes a cylindrical outer wall extending a first longitudinal distance from said fastener end, and a cylindrical inner wall coaxial to said outer wall and extending a second longitudinal distance from said fastener end, said first longitudinal distance being substantially longer than said second longitudinal distance.

25. The device of claim 20 wherein said hub engagement means includes a plurality of hub engagement sectors integrally joined to said cylindrical inner wall, said hub engagement sectors having a configuration corresponding to said tapered recess and said radially displaced rectangular configured recess.

26. The device of claim 25 wherein said hub engagement sectors include a concave configuration and converge to form a first orifice extending coaxially with said inner wall, said first orifice having a longitudinal dimension relatively longer than said second longitudinal distance of said inner wall, and relatively shorter than said first longitudinal distance of said outer wall.

27. The device of claim 20 wherein said tapered recess includes converging side walls extending from said fastener end to form a planar base wall displaced from said fastener end a distance relatively further than the displacement between said fastener end and said hub engagement sectors.

28. The device of claim 27 wherein said base wall includes a longitudinal dimension substantially equal to the diameter of said outer wall, and a lateral dimension that converges said side walls of said tapered recess to snugly receive a predetermined wingnut that ultimately engages said planar base wall.

29. The device of claim 27 wherein said side walls extend from said fastener end to form an angled base wall that engages predetermined portions of the wingnut fastener.

30. The device of claim 27 wherein said side walls extend from said fastener end to form an arcuate base wall that engages predetermined portions of the wingnut fastener.

31. The device of claim 27 wherein said tapered recess extends substantially diametrically across said fastener end of said second portion to ultimately join with said outer wall of said second portion.

32. The device of claim 27 wherein said rectangular configured recess extends substantially diametrically across said fastener end of said second portion to ultimately join with said inner wall of said second portion.

33. The device of claim 27 wherein said tapered recess includes means for gripping portions of the surface of the wingnut.

34. The device of claim 33 wherein said gripping means includes knurled side and base walls in said tapered recess.

35. The device of claim 20 wherein said second portion includes a threaded second orifice coaxial to said first orifice and extending from an end wall in said first orifice to a position proximate to said shank, said second orifice removably receiving a wingnut bolt that is secured to a workpiece via a threaded second end, said wingnut bolt removably receiving a wingnut via a threaded first end.

* * * * *